United States Patent [19]

Hancock

[11] Patent Number: 4,714,410

[45] Date of Patent: Dec. 22, 1987

[54] TRAILING EDGE SUPPORT FOR CONTROL STAGE STEAM TURBINE BLADE

[75] Inventor: Bynum V. Hancock, King, N.C.

[73] Assignee: Westinghouse Electric Corp., Pittsburgh, Pa.

[21] Appl. No.: 897,672

[22] Filed: Aug. 18, 1986

[51] Int. Cl.[4] ..... F01D 5/30

[52] U.S. Cl. ..... 416/193 A; 416/212 A

[58] Field of Search ..... 416/193 A, 212 A, 212 R, 416/219-221

[56] References Cited

U.S. PATENT DOCUMENTS

| | | | |
|---|---|---|---|
| 1,073,623 | 9/1913 | Owen et al. | 416/193 A X |
| 1,720,729 | 7/1929 | Hanzlik | 416/219 R |
| 2,148,653 | 2/1939 | Semar | 416/193 A X |
| 2,605,996 | 8/1952 | Sturgess | 416/219 R |
| 2,715,011 | 8/1955 | Schörner | 416/219 R |
| 3,014,695 | 12/1961 | Rankin et al. | 416/220 R |
| 3,923,420 | 12/1975 | Chifos | 416/212 A X |

FOREIGN PATENT DOCUMENTS

| | | | |
|---|---|---|---|
| 4365676 | 11/1926 | Fed. Rep. of Germany | 416/212 A |
| 1953709 | 4/1970 | Fed. Rep. of Germany | 416/219 |
| 78103 | 6/1980 | Japan | 416/219 R |
| 26210 | 2/1982 | Japan | 416/193 A |
| 8412 | 1/1986 | Japan | 416/212 A |
| 228272 | 11/1943 | Switzerland | 416/212 A |
| 701154 | 12/1953 | United Kingdom | 416/212 A |
| 311013 | 10/1971 | U.S.S.R. | 416/193 A |
| 985327 | 12/1982 | U.S.S.R. | 416/193 A |

*Primary Examiner*—Everette A. Powell, Jr.

*Attorney, Agent, or Firm*—F. J. Baehr, Jr.

[57] ABSTRACT

A side entry rotatable control stage blade with a wedge shape trailing edge support on the root portion which is formed to have two generally right trapezoidal surfaces which converge and a notch disposed on the opposite side of the platform with a trapezoidal surface which registers with one of the trapezoidal surfaces on the trailing edge support of the adjacent blade when the blades are disposed in a circular array in a steam turbine.

18 Claims, 10 Drawing Figures

TRAILING EDGE SUPPORT FOR CONTROL STAGE STEAM TURBINE BLADE

BACKGROUND OF THE INVENTION

This invention relates to steam turbine blades and more particularly to supports for the trailing end of the airfoil of the control stage blades.

As shown in FIGS. 1 through 4, platform portions of the blades herebefore made have a pyramid shaped extension for supporting the trailing edge of the airfoil. The pyramid shaped portions are formed to optimize the stress distribution, but the angular sides require complicating machining operations and are difficult to check for dimensional accuracy.

SUMMARY OF THE INVENTION

In general, a rotatable blade for a steam turbine, when made in accordance with this invention, comprises a root portion, a root platform portion disposed radially outwardly with respect to the root portion, an airfoil portion extending radially outwardly from the root platform portion. The airfoil portion has a leading edge and a trailing edge. The platform portion has an extention, which supports the trailing edge of the airfoil portion. The extension is wedge shaped and has two generally right trapezoidal sides and two triangular sides. The root paltform portion also has a notch with a generally right trapezoidal surface, which receives and supports the wedge shaped extension of the adjacent blade when the blades are disposed in a circular array in a steam turbine.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENT

Figure 6:
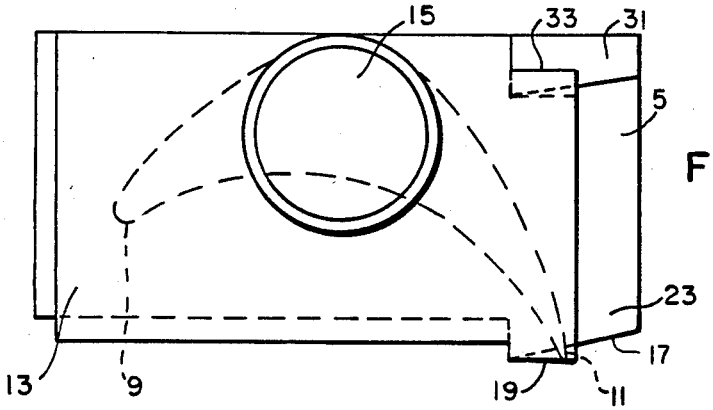
FIG. 6 is a plan view of the blade.
Figure 5:
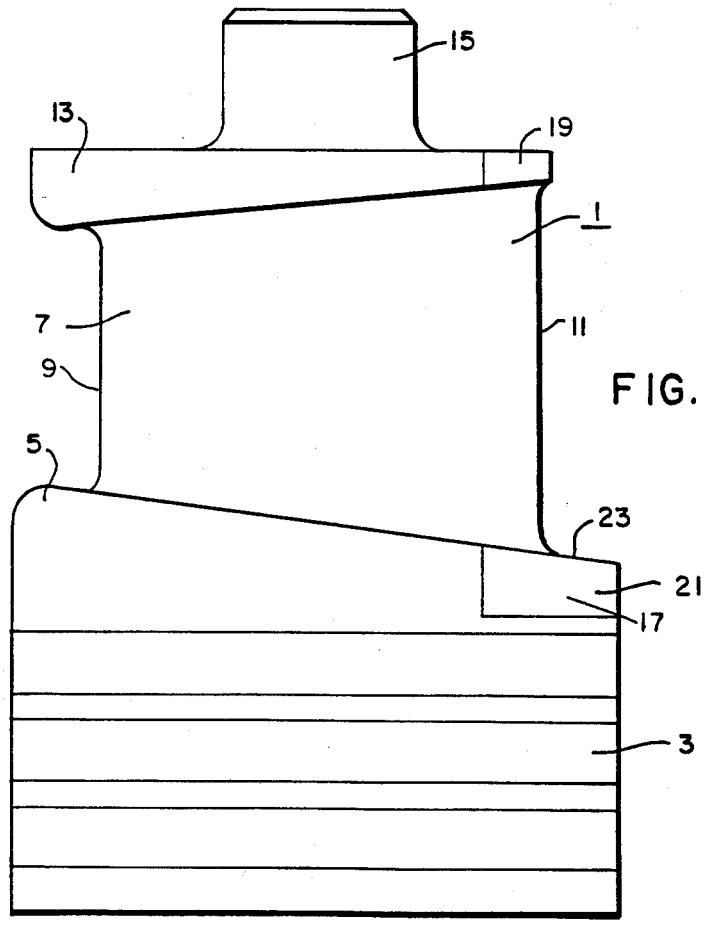
FIG. 5 is an elevational view of a steam turbine blade made in accordance with this invention.

Referring now to the drawings in detail, like reference numerals refer to similar parts in all of the figures. A rotatable side entry blade 1 for the control stage of a steam turbine is shown in FIGS. 5 and 6. The blade 1 comprises a Christmas tree shaped root portion 3, which fits into a Christmas tree shaped groove in a turbine rotor (not shown). Extending radially outwardly from the root portion 3 is a root platform portion 5, an airfoil portion 7 with a leading and trailing edge 9 and 11, respectively, a shroud platform portion 13, and a tenon 15 having a circular cross section for attaching a shroud segment (not shown) which joins the blades in groups when they are installed in a circular array in a turbine rotor (not shown). As shown in FIG. 5, the platform portions 5 and 13 decrease in thickness from the leading edge 9 to the tailing edge 11 of the blade 1.

Figure 2:
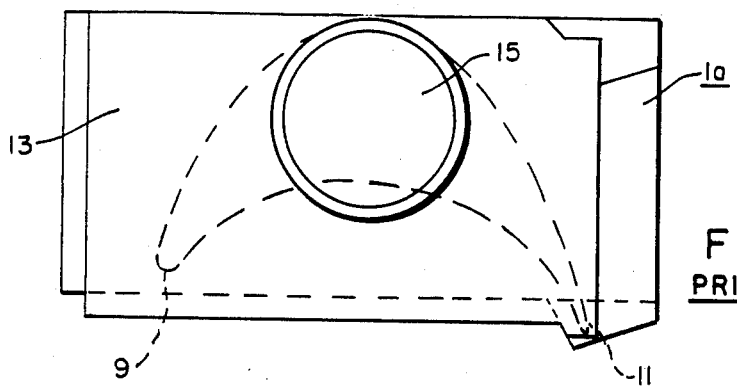
FIG. 2 PRIOR ART
FIG. 2 is a plan view of the prior art blade.
Figure 1:
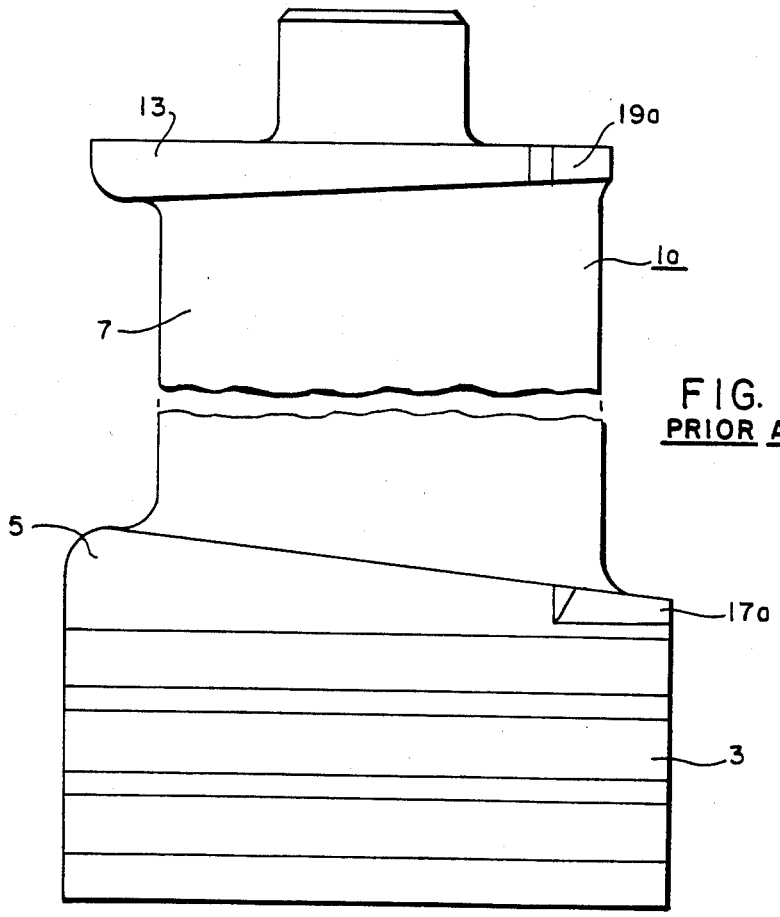
FIG. 1 PRIOR ART
FIG. 1 is an elevational view of a prior art turbine blade.
Figure 3:
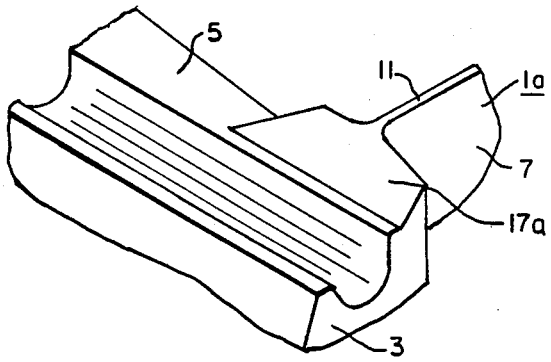
PRIOR ART FIG. 3.
FIG. 3 is an enlarged partial isometric view showing a pyramid platform extension for a prior art blade.
Figure 7:
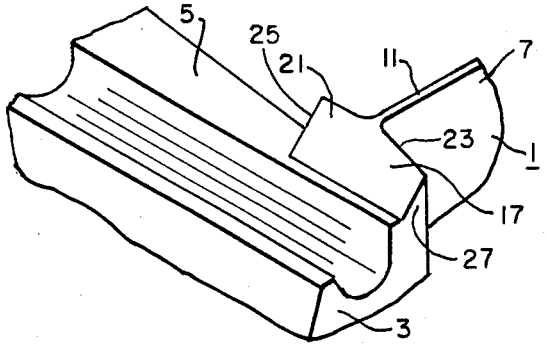
FIG. 7 is an enlarged partial isometric view showing the extension of the platform of the blade.
Figure 4:
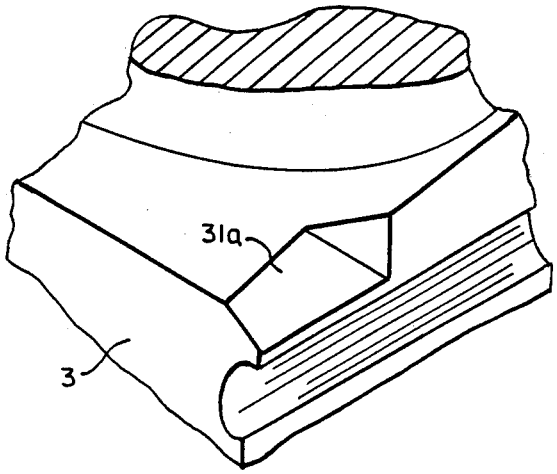
PRIOR ART FIG. 4.
FIG. 4 is an enlarged partial isometric view showing a notch in the platform of a prior art blade.
Figure 8:
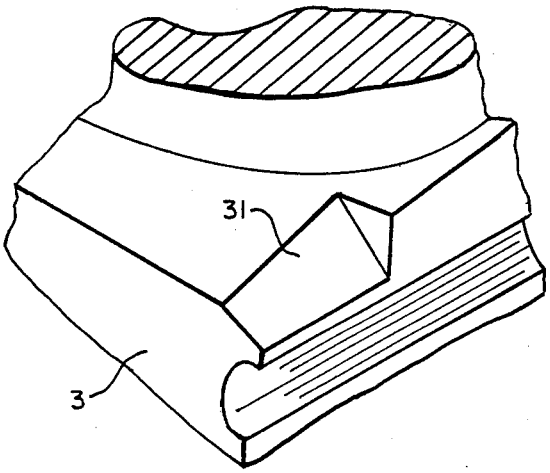
FIG. 8 is an enlarged partial isometric view showing a notch in the blade.

The trailing edge 11 of the airfoil 7 extends beyond the generally rectangular portion of the platforms 5 and 13 so that an extension 17 on the root platform portion 5 and an extension 19 on the shroud platform portion 13 are provided to support the trailing edge of the blade 1. The extension 17 on the root platform portion 5 is wedge shaped and is formed to have two right trapezoidal surfaces 21 and 23 which converge and two triangular surfaces 25 and 27 on opposite sides of the wedge shaped extension 17. The right trapezoidal surfaces 21 and 23 are formed to have a right angle where the extension 17 joins the root platform portion 5. Blades 1a herebefore made had generally quadrilateral surfaces as shown in FIGS. 1 and 4 with the inboard side of the quadrilateral forming an acute angle generally parallel to the trailing end 11 of the airfoil portion 7. This optimized the stresses in the extension 17*a*. The wedge shaped extension 17 as shown in FIGS. 5 and 7 formed with trapezoidal surfaces has some adverse stress concentrations, but is easier to manufacture, check the dimensional accuracy and eliminates the need for specially designed cutting tools.

On the opposite side of the root platform 5 is a notch 29 which also has a right trapezoidal surface 31, which registers with the right trapezoidal surface 21 on the extension 17 of the adjacent blade when the blades are assembled in a circular array in a turbine.

The extension 19 on the shroud platform 13 is generally rectangular shaped rather than trapezoidally shaped as shown in the prior art and a rectangular shaped notch 33 is disposed on the opposite side of the shroud platform 33 which registers with, or fits, the extension 19 of the adjacent blade, when the blades are disposed in a circular array in a steam turbine.

Figure 9:
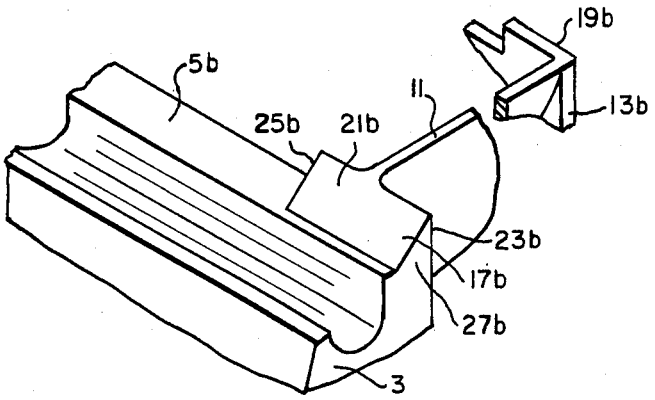
FIG. 9 is an enlarged partial isometric view showing an alternative extension and platform of the blade.
Figure 10:
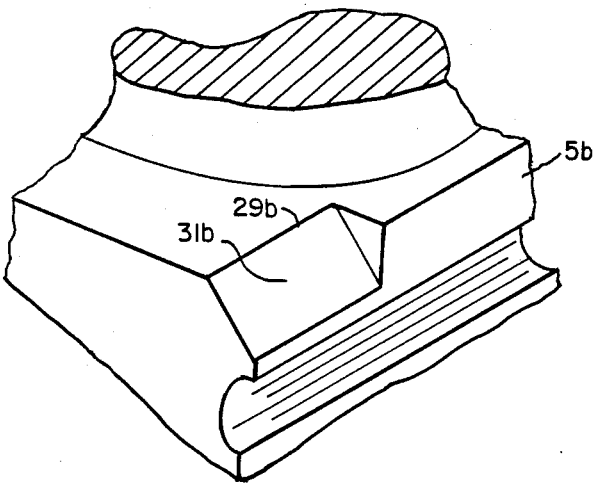
FIG. 10 is an enlarged partial isometric view showing an alternative notch and platform of the blade.

FIG. 9 shows another embodiment in which an extension 17*b* extends from the root platform 5 and an extension 19*b* extends from the shroud platform 13*b*. The extension 17*b* is formed to have two rectangular surfaces 21*b* and 23*b* which converge and two triangular surfaces 25*b* and 27*b* on opposite sides of the wedge-shaped extension 17*b*. The surfaces 21*b* and 23*b* are rectangular because the root platform 5*b* is generally a constant thickness. FIG. 10 shows a notch 29*b* in the root platform 5*b* which has a rectangular surface 31*b*. The notch 29*b* registers with the extension 19*b* on the adjacent blade when the blades are disposed in a circular array in a rotor of a steam turbine.

The extensions 17 and 19 for supporting the trailing edge 11 of the airfoil portion 7 of the blade 1 while resulting in some adverse stresses advantageously make the blades easier to manufacture and measure the dimensional accuracy of the particular elements, eliminate specially designed cutters and allow simple clearance checks upon assembly of the blades in a circular array. The angular cut herebefore utilized necessitated measurements over a roll pin and generating a compound angle on the trailing edge support and in the notch in the platform, both of which are difficult to machine.

What is claimed is:

1. A rotatable blade for a steam turbine comprising:
a root portion;
a root platform portion disposed radially outwardly with respect to the root portion;
an airfoil portion extending radially outwardly from the root platform portion and having a leading and a trailing edge;
said root platform portion having an extension which supports the trailing edge of the airfoil portion;
said extension being wedge shaped and having two generally right trapezoidal surfaces and two triangular shaped sides; and
said root platform having a notch with a generally right trapezoidal surface which receives and supports the wedge shaped extension of the adjacent blade when the blades are disposed in a circular array on a steam turbine.

2. A rotatable blade as set forth in claim 1 and further comprising a shroud platform portion disposed radially outwardly from the airfoil portion.

3. A rotatable blade as set forth in claim 2, wherein the shroud platform portion has a shroud extension which supports the trailing edge of the airfoil portion.

4. A rotatable blade as set forth in claim 3, wherein the shroud platform portion has a notch for receiving the shroud extension of the adjacent blade when the blades are disposed in a circular array in the turbine.

5. A rotatable blade as set forth in claim 4, wherein the shroud platform portion has a tenon extending radially outwardly therefrom.

6. a rotatable blade as set forth in claim 5, wherein the tenon has a circular cross section and is utilized to attach a shroud ring which joins the blade in groups when the blades are disposed in a circular array in a steam turbine.

7. A rotatable blade as set forth in claim 6, wherein the root portion has a generally Christmas tree shaped cross section.

8. A rotatable blade as set forth in claim 7, wherein the thickness of the root platform decreases from the leading to the trailing end of the airfoil portion.

9. A rotatable blade as set forth in claim 8, wherein the thickness of the shroud platform portion decreases in thickness from the leading to the trailing end of the airfoil portion.

10. A rotatable blade as set forth in claim 9, wherein the distance between the root platform portion and the shroud platform portion increases from the leading to the trailing edge of the airfoil portion.

11. A rotatable blade for a steam turbine comprising:
a root portion;
a root platform portion disposed radially outwardly with respect to the root portion;
an airfoil portion extending radially outwardly from the root platform portion and having a leading and a trailing edge;
said root platform portion having an extension which supports the trailing edge of the airfoil portion;
said extension being wedge shaped and having two generally rectangular surfaces and two triangular shaped sides; and
said root platform having a notch with generally rectangular surface which receives and supports the wedge shaped extension of the adjacent blade when the blades are disposed in a circular array on a steam turbine.

12. A rotatable blade as set forth in claim 11 and further comprising a shroud platform portion disposed radially outwardly from the airfoil portion.

13. A rotatable blade as set forth in claim 12, wherein the shroud platform portion has a shroud extension which supports the trailing edge of the airfoil portion.

14. A rotatable blade as set forth in claim 13, wherein the shroud platform portion has a notch for receiving the shroud extension of the adjacent blade when the blades are disposed in a circular array in the turbine.

15. A rotatable blade as set forth in claim 14, wherein the shroud platform portion has a tenon extending radially outwardly therefrom.

16. A rotatable blade as set forth in claim 15, wherein the tenon has a circular cross section and is utilized to attach a shroud ring which joins the blade in groups when the blades are disposed in a circular array in a steam turbine.

17. A rotatable blade as set forth in claim 16, wherein the root portion has a generally Christmas tree shaped cross section.

18. A rotatable blade as set forth in claim 17, wherein the thickness of the root platform is generally constant from the leading to the trailing end of the airfoil portion.

* * * * *